US006973924B1

(12) United States Patent
Suzuki

(10) Patent No.: US 6,973,924 B1
(45) Date of Patent: Dec. 13, 2005

(54) EVAPORATIVE FUEL CONTROL SYSTEM FOR INTERNAL COMBUSTION ENGINE

(75) Inventor: Ryoji Suzuki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 11/134,525

(22) Filed: May 20, 2005

(30) Foreign Application Priority Data

May 21, 2004 (JP) ..... 2004-151366

(51) Int. Cl.[7] ..... F02M 33/02
(52) U.S. Cl. ..... 123/519
(58) Field of Search ..... 123/518, 519, 123/520, 521, 434, 198 D

(56) References Cited

U.S. PATENT DOCUMENTS 5,299,545 A * 4/1994 Kuroda et al. ..... 123/520
5,355,863 A * 10/1994 Yamanaka et al. ..... 123/520
6,789,523 B2 * 9/2004 Oki et al. ..... 123/198 D
6,854,452 B2 2/2005 Morinaga et al.

FOREIGN PATENT DOCUMENTS

JP 11-336620 A 12/1999
JP 2002-256988 A 9/2002
JP 2003-120437 A 4/2003

* cited by examiner

*Primary Examiner*—Bibhu Mohanty
(74) *Attorney, Agent, or Firm*—Flynn, Thiel, Boutell & Tanis, P.C.

(57) ABSTRACT

An evaporative fuel control system for an internal combustion engine having improved leak check precision and decreased false check results.

The system provides a controller including a leak check control section to operate the leak check system, a refuel detecting section to determine whether refueling of the fuel tank has occurred, a purge quantity totalizing section to add up the quantity of purge during operation of the engine, and a leak check stop section to prevent the leak check until the total purge quantity that is added by the purge quantity totalizing section during operation of the engine is larger than a predetermined value if refueling is determined by the refuel check section.

4 Claims, 5 Drawing Sheets

DETERMINATION OF REFUEL

AIR-FLOW IN MEASURING REFERENCE PRESSURE

AIR-FLOW IN VACUUMING THE EVAPORATIVE SYSTEM

EVAPORATIVE FUEL CONTROL SYSTEM FOR INTERNAL COMBUSTION ENGINE

This application is 1 of 3 related, concurrently filed applications, all entitled "Evaporative Fuel Control System for Internal Combustion Engine", all having the same inventorship, and having Ser. Nos. 11/134,524, 11/134,525, and 11/134,523 respectively. The disclosure of the related copending applications are herein incorporated by reference.

FIELD OF THE INVENTION

This invention relates to an evaporative fuel control system for an internal combustion engine, and more particularly to an evaporative fuel control system with improved precision owing to the total purge quantity after determination of refueling which is included in an (evaporative fuel) leak check start condition.

BACKGROUND OF THE INVENTION

Traditional designs of internal combustion engines permit for unwanted air pollution and loss of fuel due to evaporation of the hydrocarbon (HC) containing fuel from the tank, the carburetor, and other engine components. There is existing prior art that attempts to obviate these problems. In particular, there is an evaporative fuel control system which employs a fuel vapor collection canister containing an adsorbent material, such as activated carbon, for adsorbing evaporative fuel, and a purge system for releasing the adsorbed fuel and supplying it to the engine during operation of the engine. This evaporative fuel control system also includes a leak check system which employs different leak check methods to check for leakage of the evaporative fuel (leak of vapor) to the atmosphere.

One method by which the leak check system checks for leaks is by employing a pressure reducing pump or an electric pump, a switching valve, a reference orifice, and a pressure sensor to check leakage during stop of the engine. With this method, a reference pressure is measured after the atmosphere is vacuumed through the reference orifice by the pressure reducing pump, and a pressure within the evaporative fuel control system is measured after a certain time has elapsed after the switching valve is shifted such that a fuel tank is vacuumed or is subject to an internal negative pressure. By comparing between this measured pressure and the reference pressure, it is determined whether there is leakage larger than the reference orifice.

In one of the conventional leak check systems of the evaporative fuel control system, a pressure condition of the evaporative fuel is detected after the engine is stopped and a leak check condition is satisfied to process for initialization. In order to avoid false results, the leak check is prevented if the pressure of the evaporative fuel is more than or equal to a predetermined value. After the evaporative pressure is below the predetermined value, the leak check is carried out. Also, there are some leak check systems that avoid false check results due to an opened fuel cap during refueling. In these systems, a leak is examined with negative pressure in the evaporative fuel control system. The leak check is prevented if the pressure in the fuel tank is above a predetermined value when the vehicle is stopped. Further, there are some leak check systems that try to avoid a false check result due to an opened fuel cap during refueling by comparing a remaining amount of fuel at start of the engine with a remaining amount of fuel at last engine stop to determine whether the fuel cap is opened while the engine is stopped. If the fuel cap is opened when the engine is stopped while refueling, the leak check result is canceled to avoid a false check result due to the opened fuel cap. See JP Laid-Open No. H11-336620, JP Laid-Open No. 2002-256988, JP Laid-Open No. 2003-120437.

The check method of the conventional evaporative fuel control system is more precise than the prior method, since leakage is tested during stop of the engine during which the evaporative fuel is stable. However, in conditions where significant vaporized gas is generated due to refueling, the precision of the detection can be detrimentally affected, which leads to mistaking a no leakage condition for leakage.

On this account, JP Laid-Open No. 2003-120437 discloses a suggestion to cancel the leak check if the leak check is performed during stop of the engine and then if the refueling is detected at start of the engine.

However, without a sufficient purge of the evaporative fuel generated by the refueling after start of the engine, application of the leak check may be wrongly determined when the leak is tested again during a subsequent engine stop.

SUMMARY OF THE INVENTION

In order to obviate, or at least minimize, the above inconveniences, the present invention provides an evaporative fuel control system for an internal combustion engine. In this system, a canister for absorbing the evaporative fuel is disposed on an evaporative fuel control passage which connects an intake passage for the engine to a fuel tank. An atmosphere open passage permits the canister to open to the atmosphere. An atmosphere open/close valve is disposed in the atmosphere open passage. A purge valve is disposed on the evaporative fuel control passage between the intake passage and the canister. The canister absorbs the evaporative fuel generated in the fuel tank, and the purge valve supplies the evaporative fuel absorbed by the canister to the intake passage for a purge control. A fuel level detector detects fuel quantity in the fuel tank. A leak check system examines leakage in the evaporative fuel control system by closing the atmosphere open/close valve during stop of the engine and causing negative pressure in the evaporative fuel control system. A controller includes a leak check control section to operate the leak check system, a refuel detecting section to determine whether there is an oil charge to the fuel tank by the fuel level detector, a purge quantity totalizing section to add up the quantity of purged fuel during operation of the engine, and a leak check stop section to prevent the leak check until the total purge quantity, determined by the purge quantity totalizing section during operation of the engine after refueling is determined by the refuel check section, is larger than a predetermined value.

According to the present invention, the leak check is not carried out in a situation where much of evaporative fuel is generated just after refueling, which decreases possibility of false check result and improves precision.

DETAILED DESCRIPTION OF THE INVENTION

The present invention improves the precision of the leak check for the evaporative fuel control system, which is an object of the present invention, by addition of the total purge quantity after refueling is detected to a leak check start condition.

FIGS. 1–7 illustrate one embodiment of the present invention.

Figure 5:
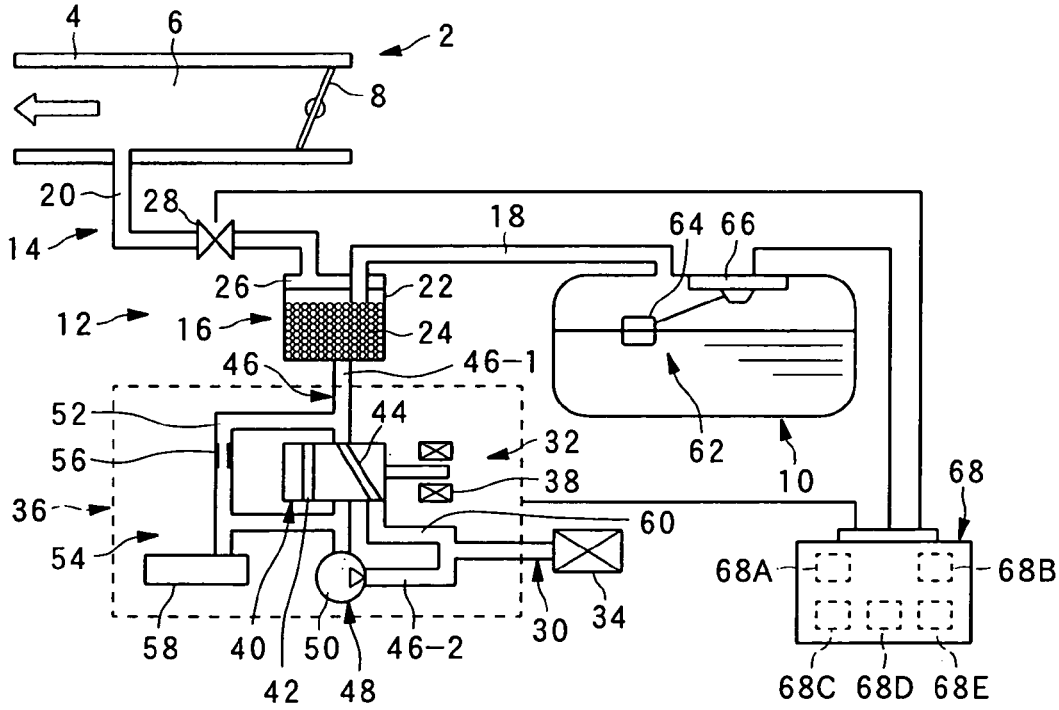
FIG. 5 is a diagram of an evaporative fuel control system.

FIG. 5 shows an internal combustion engine 2 mounted on a vehicle (not shown), an intake pipe 4 of the engine 2, an intake passage 6 defined by the intake pipe 4, a throttle valve 8 disposed in the intake passage 6, a fuel tank 10 to store fuel, and an evaporative fuel control system (evaporative system) 12.

In the evaporative fuel control system 12, an evaporative fuel control passage 14 connects an upper part of the fuel tank 10 with the intake passage 6 on a downstream side of the throttle valve 8. On the evaporative fuel control passage 14, canister 16 is disposed to absorb the evaporative fuel generated in the fuel tank 10. In this manner, the evaporative fuel control passage 14 is formed by an evaporative passage 18 connecting the fuel tank 10 with the canister 16, and a purge passage 20 connecting the canister 16 with the intake passage 6.

The canister 16 contains an activated carbon in an activated carbon section 24 in a boxy canister body 22 to absorb the evaporative fuel, and connects, at a top section thereof, the evaporative passage 18 with the purge passage 20. The evaporative passage 18 is directly connected to the activated carbon section 24, and the purge passage 20 is connected to an upper space 26 defined in the canister body 22.

On the purge passage 20, a purge valve 28 is disposed to control the quantity of evaporative fuel (purge quantity) that is purged by the canister 16 and supplied to the intake passage 6. Duty ratio of this purge valve 28 is controlled between 0–100%. That is, the purge valve 28 is closed at duty ratio 0% to shut the purge passage 20, and is opened at duty ratio 100% to open the purge passage 20. Opening degree of the purge passage 20 can be changed between duty ratio 0–100% for a purge control of the evaporative fuel absorbed in the canister 16 to supply to the intake passage 6.

On a lower part of the canister 16, a main passage 46 is connected to open the canister 16 to the atmosphere. Disposed on this mainpassage 46 is a switching valve 32 functioning as an atmosphere open/close valve (canister air valve) to connect/disconnect the air. Connected to main passage 46 is an atmosphere open passage 30 which has at one end thereof an air filter 34 to remove dust introduced from outside.

The evaporative fuel control system 12 includes a leak check system (leak check module) 36.

More particularly, the switching valve 32 has a solenoid 38 and a valve element 40 that is operated by energizing the solenoid 38. The valve element 40 includes a straight port 42 and a diagonal port 44. The atmosphere open passage 30 at one end connects via main passage 46 through the switching valve 32 to the canister 16, and has mounted on the other end 30 an air filter 34. The main passage 46 is defined by a first main passage 46-1 toward the canister 16 with respect to the switching valve 32, and a second main passage 46-2 toward the air filter 34. Located on the second main passage 46-2 is a pressure reducing pump 50 that acts as a pressure reducing means 48, which vacuums or generates a negative pressure (pressure less than that of the ambient atmosphere) inside the evaporative fuel control system 12. While bypassing the switching valve 32, the main passage 46 includes a first bypass passage 52 of which one end is connected to the first main passage 46-1 located toward the canister 16 with respect to the switching valve 32, and the other end is connected to the second main passage 46-2 located between the switching valve 32 and the pressure reducing pump 50. On the first bypass passage 52, a reference orifice 56 is disposed as a reference pressure detector 54 to detect the reference pressure within the evaporative fuel control system 12, and a pressure sensor 58 is disposed toward the pressure reducing pump 50 with respect to the reference orifice 56. Also, on the second main passage 46-2 toward the air filter 34 with respect to the pump 50, a second bypass passage 60 is disposed to connect to the switching valve 32.

Figure 6:
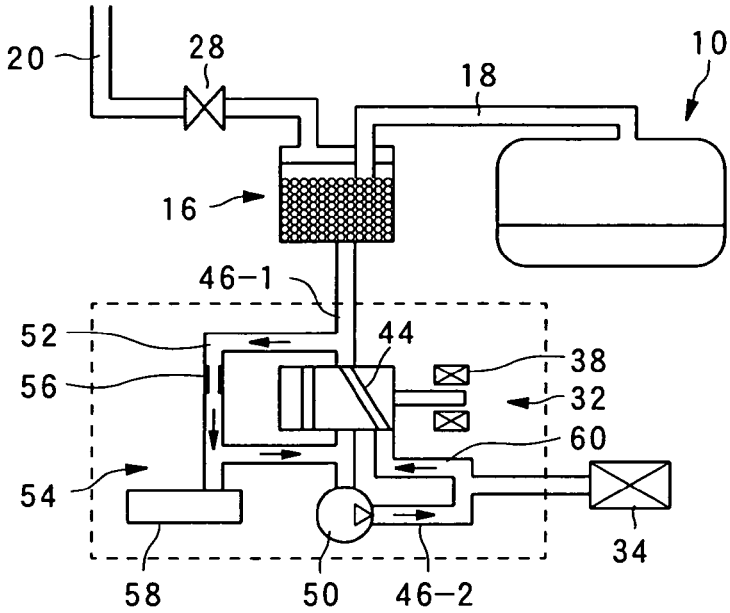
FIG. 6 is a diagram of the evaporative fuel control system of FIG. 5 when measuring reference pressure.
Figure 7:
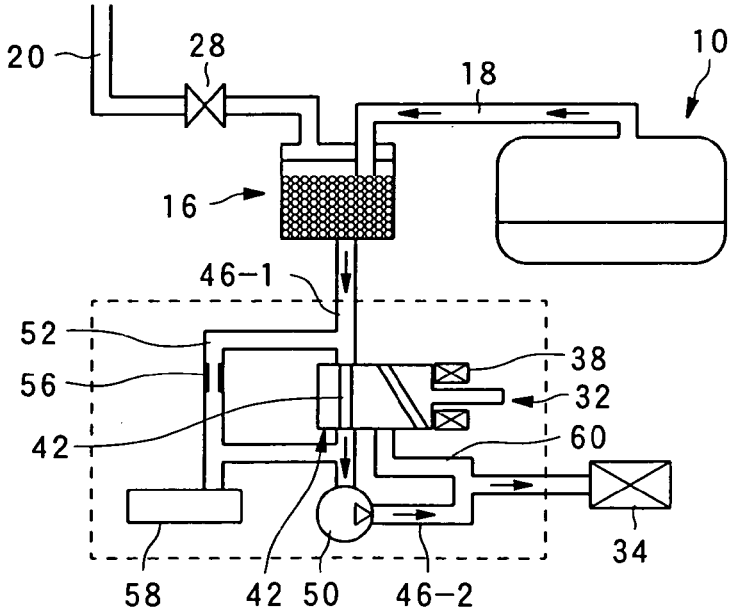
FIG. 7 is a diagram of the evaporative fuel control system of FIG. 5 when the evaporative system is vacuumed.

As shown in FIG. 6, the switching valve 32 shuts the main passage 46 when the solenoid 38 is not energized (deactivated) and the diagonal port 44 is positioned to communicate with the first main passage 46-1. Also as shown in FIG. 7, the switching valve 32 communicates the main passage 46 with the pressure reducing pump 50 when the solenoid 38 is energized (activated) and the straight port 42 is positioned between the first main passage 46-1 and second main passages 46-2.

In particular, the leak check system 36 examines leaks within the evaporative fuel control system 12 by closing the switching valve 32 or the atmosphere open/shut valve during stop of the engine 2, causing negative pressure in the evaporative fuel control system 12. More particularly, the atmosphere open passage 30 includes the switching valve 32 to communicate/disconnect the evaporative fuel control system 12 to the atmosphere, the reference pressure detector 54 to detect the reference pressure within the evaporative fuel control system 12, and the pressure reducing means 48 that vacuums or generates a negative pressure inside of the evaporative fuel control system 12. Leakage within the evaporative fuel control system 12 is examined by using the reference pressure detected by the reference pressure detector 54 and a reduced pressure in which the switching valve 32 is switched to an atmosphere shut side and the pressure reducing means 48 vacuums the evaporative fuel control system 12 during stop of the engine 2.

The fuel tank 10 includes a fuel level detector 62 to detect the quantity of fuel in the fuel tank 10. This fuel level detector 62 includes a fuel level gauge 64 which moves upward or downward in accordance with the fuel in the fuel tank 10, and a fuel sensor 66 to send electric signals according to the fuel quantity based on the upward or downward movement of the fuel level gauge 64.

A controller (ECM) 68 is connected to the purge valve 28, the switching valve 32, the pressure reducing pump 50, the pressure sensor 58, and the fuel sensor 66.

This controller 68 includes a leak check control section 68A, a refuel detecting section 68B, a purge quantity totalizing section 68C, a leak check stop section 68D, and a timer 68E. More particularly, the leak check control section 68A activates or deactivates the leak check system 36. The refuel detecting section 68B determines whether oil is refueled to the fuel tank by the fuel level detector 62. The purge quantity totalizing section 68C adds up the quantity of purged evaporative fuel during operation of the engine. The leak check stop section 68D prevents the leak check until the total quantity of purged fuel that is added by the purge quantity totalizing section 68C, during operation of the engine after the leak check section 68B has determined that refueling has occurred, is larger than a predetermined value. The purge quantity totalizing section 68C adds up the purge quantity (purge time) based on, e.g., open or shut operation of the purge valve 28.

Operation of this embodiment is explained below.

Figure 1:
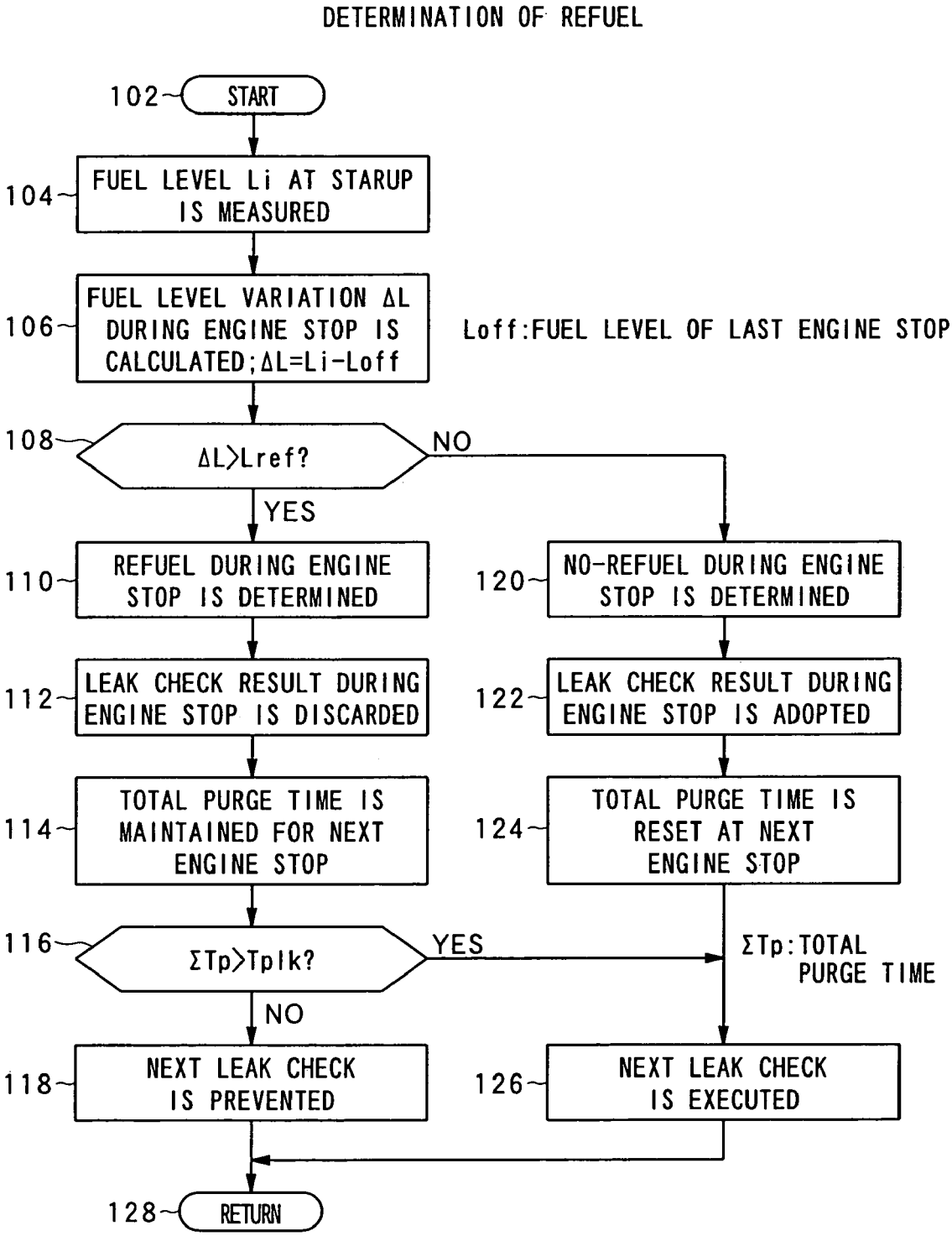
FIG. 1 is a flowchart depicting one method of determining whether refueling occurred.

FIG. 1 shows a flowchart for determining whether refueling has occurred. A program for determination of refueling starts at step 102. Fuel level $L_i$ at start of the engine 2 is measured in step 104. Then, fuel level variation L during stop of the engine 2 is calculated in step 106 ($L=Li-L_{off}$). Here, $L_{off}$ is the fuel level present when the engine 2 was last stopped.

Then a determination is made in step 108 as to whether L is greater than $L_{ref}$.

If the determination in step 108 is "YES", then it is decided in step 110 that refueling occurred during stop of the engine 2, and results in cancellation or discardment of the leak check during stop of the engine 2 in step 112, and the total purge time (purge quantity) Tp is maintained until next stop of the engine 2 in step 114.

Then a determination is made in step 116 whether Tp is greater than Tplk (Tp>Tplk). Tplk is a predetermined value.

If the determination in step 116 is "NO", then the next leak check is prevented in step 118.

On the other hand, if the determination in step 108 is "NO", then it is decided in step 120 that no refueling occurred during stop of the engine 2. Consequently, the result of the leak check during stop of the engine 2 is adopted or maintained in step 122, and total purge time (purge quantity) is reset at the next stop of the engine 2 in step 124.

After reset of the total purge time (quantity) in step 124 or if the determination in step 116 is "YES", next leak check can be carried out in step 126.

After step 118 or step 126, the program returns in step 128.

Figure 2:
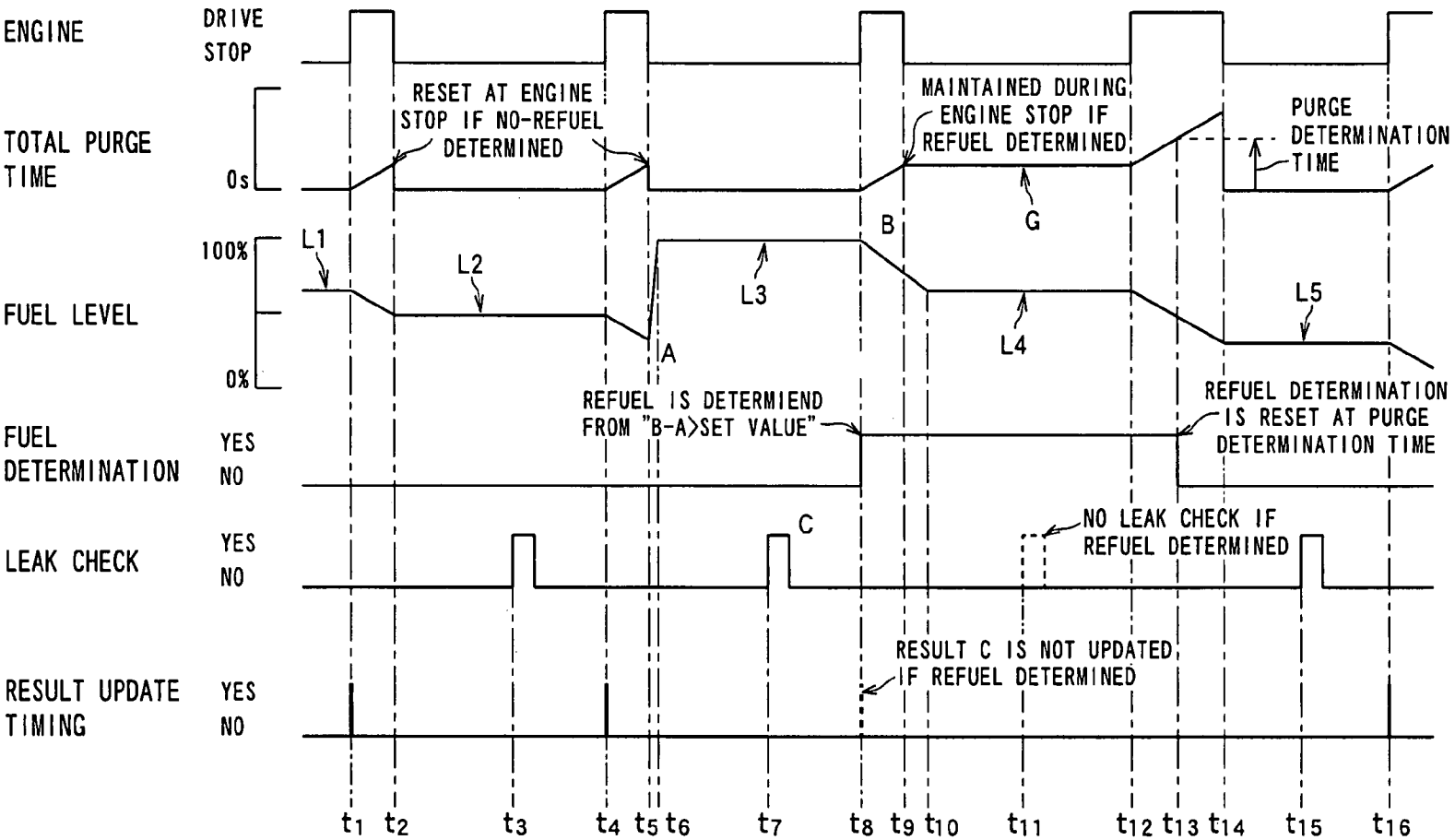
FIG. 2 is a time chart depicting when various actions occur during determination of a refuel condition.

Next, this determination of refuel is explained below with reference to FIG. 2 showing a time chart for determination of refuel. After time $t_1$ at which the engine 2 is changed to a drive state from a stop state, the total purge time (purge quantity) increases from a reset state, i.e., zero, and the fuel level gradually decreases from a certain level L1. At this time, since the fuel level variation is small and therefore no-refuel is determined, there is permitted an update timing in which last leak check result is updated or supersedes.

At time $t_2$ when the engine 2 is switched to the stop state, the total purge time is reset since there was no determination of refuel. The fuel level is maintained at level L2. Then a check for leakage is carried out at time $t_3$, since there was no determination of refueling.

After time $t_4$ at which the engine 2 is driven again, the total purge time increases from the reset state, zero, and the fuel level gradually decreases from Level L2. At this time, since the fuel level variation is small and therefore no-refuel is determined, there is permitted the update timing in which last leak check result is updated or supersedes.

At time $t_5$ when the engine 2 is stopped, the total purge time decreases to zero due to determination of no-refuel. Just after this at time $t_6$, the fuel level which decreased to level L1 then increases to level L3, substantially at 100%, and is maintained at this level L3. Then the leak check C is carried out at time $t_7$, since the refuel condition has not yet been determined.

At time $t_8$ when the engine 2 is driven, the total purge time starts to increase from zero (reset state) and the fuel level gradually decreases from level L3. At this time $t_8$, the fuel level is at level B where the fuel level is maintained at level L3, so that it is determined that a refueling occurred in consideration of the relationship (B−A>predetermined value), therefore the update timing for result of the past leak check C is canceled (shown by a dashed line).

After time $t_9$ when the engine 2 is stopped, since there was a determined refueling, the total purge time is not reset but maintained at value G. On the other hand, the fuel level gradually decreases and is maintained at level L4, substantially in the middle between level A and level B, at time $t_{10}$. At time $t_{11}$, this leak check is not executed (shown by a dashed-line) since a refuel condition was detected based on the relationship (B−A>predetermined value).

At time $t_{12}$ when the engine 2 is driven, the total purge time further increases from value G, and the fuel level gradually decreases from level L4. Then at time $t_{13}$, if the total purge time is at a predetermined value (purge determination time), the determination of refuel is reset.

At time $t_{14}$ when the engine 2 is stopped, the total purge time decreases to the reset state, zero, since the refuel determination was reset, and the fuel level is maintained at level L5. Then another leak check is performed at time $t_{15}$, since there was no refuel determination.

After time $t_{16}$ when the engine 2 is driven, the total purge time increases from the reset state, zero, and the fuel level gradually decreases from level L5. It is determined that no refueling occurred since the fuel level variation is small, so that the previous result of the leak check is updated or adopted. Further this determination is similarly repeated.

Figure 3:
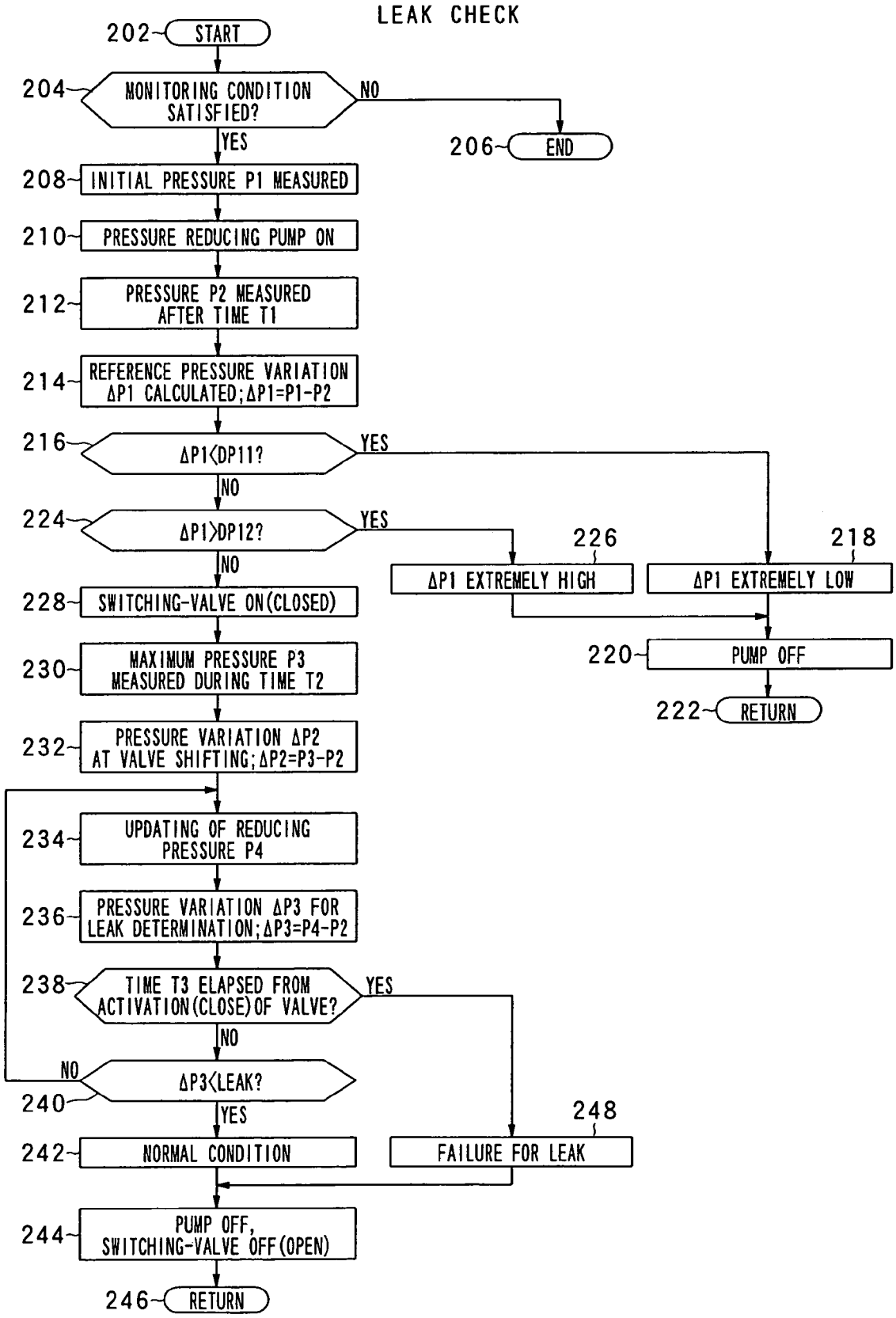
FIG. 3 is a flowchart depicting the steps involved in a leak check.

If a leak-check start condition is satisfied, the leak check is performed based on a flowchart shown in FIG. 3.

As shown in FIG. 3, after a program for the leak check starts in step 202, a determination is made in step 204 whether a monitoring condition is satisfied. If the determination in step 204 is "NO", the program ends in step 206.

If the determination in step 204 is "YES", then an initial pressure P1 in the evaporative fuel control system 12 is measured in step 208. At this time, the switching valve 32 has been deactivated (opened), and the pressure reducing pump 50 is activated in step 210. After a certain time T1 has elapsed from deactivation (opening) of the switching valve 32, a pressure P2 in the evaporative fuel control system 12 is measured in step 212. Then a reference pressure variation P1 is calculated in step 214 (P1=P1−P2). As shown in FIG. 6 wherein the switching valve 32 is deactivated (open) and the pressure reducing pump 50 is activated, the atmosphere open passage 30 is suitable to measure the reference pressure while the switching valve 32 shuts the main passage 46 from passing through switching valve 32. Instead, the main passage 46 is forced to communicate with the first and second bypass passages 52 and 60 so as to bypass the switching valve 32.

Then a determination is made in step 216 whether P1 is smaller than DP11 (P1<DP11; DP11 being a predetermined value).

If the determination in step 216 is "YES", then it is determined in step 218 that the reference pressure variation P1 is extremely low. Then the pressure reducing pump 50 is deactivated in step 220, and the program returns in step 222.

If the determination in step 216 is "NO", then another determination is made in step 224 whether P1 is greater than DP12 (P1>DP12; DP12 being a predetermined value).

If this determination in step 224 is "YES", it is determined in step 226 that the reference pressure variation P1 is extremely high, and the program goes to step 220.

If the determination in step 224 is "NO", then the switching valve 32 is activated (closed) in step 228. As shown in FIG. 7 wherein the switching valve 32 is activated (closed) and the pressure reducing pump 50 is deactivated, the atmosphere open passage 30 is under decreased pressure while the straight port 42 of the switching valve 32 communicates with the main passage 46. Then, a maximum pressure P3 in the evaporative fuel control system 12 during a certain time T2 is measured in step 230. A pressure variation P2 at switching of the valve is calculated in step 232 (P2=P3−P2).

Then a reducing pressure P4 in the evaporative fuel control system 12 is updated in step 234, and a pressure variation P3 for leak determination is calculated in step 236 (P3=P4−P2).

Then a determination is made in step 238 whether a certain time T3 has elapsed from the activation (closing) of the switching valve 32.

If the determination in step 238 is "NO", then another determination is made in step 240 whether P3 is smaller than LEAK (P3<LEAK; LEAK being a predetermined value). If the determination in step 238 is "NO", then the program repeats the process of step 234.

If the determination in step 240 is "YES", it is concluded in step 242 that the evaporative fuel control system 12 is in a normal condition. The pressure reducing pump 50 is deactivated and the switching valve 32 is deactivated (opened) in step 244 (see FIG. 7), and the program returns in step 246.

Alternatively, if the determination in step 238 is "YES", it is determined that the evaporative fuel control system 12 is in a failure for leak condition, and the program goes to step 244.

Next, this leak check is explained below with reference to the time chart of FIG. 4.

Figure 4:
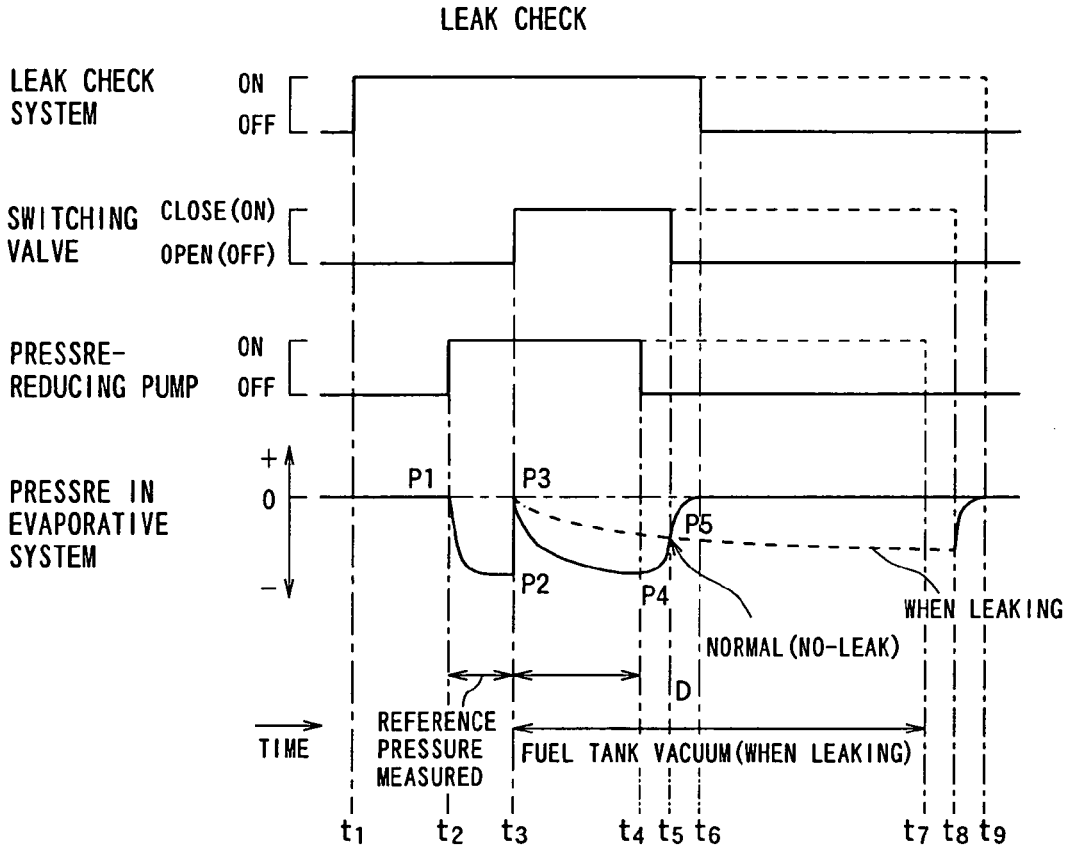
FIG. 4 is a time chart depicting the various stages of a leak check.

In FIG. 4, after the leak check system 36 is activated at time $t_1$ and the pressure reducing pump 50 is activated at time $t_2$, the pressure in the evaporative fuel control system 12 decreases toward a negative pressure value (−) from pressure P1 (substantially zero). At time $t_3$ when the switching valve is shifted for activation, the negative pressure in the evaporative fuel control system 12 rapidly increases toward a positive pressure (+) from pressure P2 to pressure P3 (substantially zero). The reference pressure in the evaporative fuel control system 12 has been measured between time $t_2$ and time $t_3$.

While the switching valve 32 is maintained in an active state, the pressure in the evaporative fuel control system 12 begins to decrease toward the negative side (−) from the pressure P3.

If the evaporative fuel control system 12 is in the normal condition (without leak, shown by a solid line in FIG. 4), the pressure in the evaporative fuel control system 12 suddenly begins to decrease until minimum pressure P4 equals the reference pressure P2 at time $t_4$. Time between time $t_3$ and time $t_4$ is a pressure reducing time for normal condition. Then at time $t_5$ when the switching valve 32 is deactivated, the pressure in the system 12 reaches pressure P5 toward the positive side. At time $t_6$ when the leak check system is deactivated, the pressure in the system 12 is maintained at zero.

In contrast, if the evaporative fuel control system 12 is in an abnormal condition with leakage (shown by a dashed-line in FIG. 4), the pressure in the system 12 is toward zero with respect to the pressure of normal condition, which is relatively lower negative pressure. At time $t_5$, the pressure in the evaporative fuel control system 12 is at pressure P5. With long delay as compared to the normal condition, the pressure reducing pump 50 is deactivated at time $t_7$. After time $t_8$ when the switching valve 32 is deactivated and after time $t_9$ when the leak check system 36 is deactivated, the pressure in the evaporative fuel control system 12 is maintained at zero toward positive side.

As a result, if the occurrence of a refuel is detected, the leak check is prevented until the purge quantity is greater than the predetermined value during operation of the engine 2 after refueling. Whether the leak check is executed is determined in combination with refuel determination and the total purge time. The leak check is not performed in a condition where the evaporative fuel is generated in significant quantities just after refueling. This minimizes the false check result and improves the precision of the leak check in comparison to conventional leak check systems utilizing purge.

Also, in the leak check system 36, the atmosphere open passage 30 includes the switching valve 32 to communicate/disconnect to the atmospheric air, the reference pressure detector 54 to detect the reference pressure within the evaporative fuel control system 12, and the pressure reducing means 48 to vacuum or generate a negative pressure inside of the evaporative fuel control system 12. Leakage within the evaporative fuel control system 12 is examined by using the reference pressure detected by the reference pressure detector 54 and a reduced pressure in which the switching valve 32 is switched to the atmosphere shut side and the pressure reducing means 48 vacuums the evaporative fuel control system 12 during stop of the engine 2. Even if the evaporative fuel control system 12 is forced to reduce pressure inside for the leak check, the leak check is not performed under a condition where much evaporative fuel is produced just after refueling. This reduces the possibility of a false check result and improves precision of the leak check.

That is, in this embodiment of the present invention, the start condition for the leak check of the leak check method is modified to induce the condition whether the total purge time (total purge quantity) after determination of refueling is greater than the predetermined value. The fuel level is measured at start of the engine 2, and the fuel level variation ÄL is calculated from the fuel level of last engine 2 stop. If this fuel level variation ÄL is greater than the predetermined value, it is decided that refueling occurred during stop of the engine 2, so that the leak check result obtained during stop of the engine 2 is canceled or discarded and the total purge time (purge quantity) is set to be maintained even during stop of the engine 2. On the other hand, if the fuel level variation ÄL is less than or equal to the predetermined value, then it is determined that refueling did not occur during stop of the engine 2, so that the leak check result carried out during stop of the engine 2 is adopted or maintained. The total purge time (purge quantity) is reset at stop of the engine 2 and the leak check at subsequent stop of the engine 2 will be executed. If the refuel is determined during stop of the engine 2, then the result of the leak check during stop of the engine 2 is canceled. After it is switched so that the total purge time (purge quantity) is maintained even during stop of the engine 2, the result of the refuel determination is reset (no refuel) when the total purge time reaches the predetermined value, and the leak check is permitted at next stop of the engine 2. Alternatively if the total purge time does not reach the predetermined value, this condition is maintained to improve precision of the leak check.

Incidentally, in the embodiment of the present invention, as a determination whether the leak check is carried out, it may be determined that significant evaporative fuel is generated if the pressure or pressure variation in the evaporative passage is determined to be large by the pressure detector which detects the pressure in the evaporative passage to effectively check for the leak.

Beyond the obvious application suggested in the previous examples, addition of the purge quantity after detection of refueling to a leak check start condition, can be advantageously applied to other leak check systems.

What is claimed is:

1. An evaporative fuel control system for an internal combustion engine having a canister disposed on an evaporative fuel control passage for absorbing evaporative fuel, said canister connecting to an intake passage for the engine and a fuel tank, an atmosphere open passage to permit the canister to open to the atmosphere, an atmosphere open/close valve disposed on the atmosphere open passage, and a purge valve disposed on the evaporative fuel control passage between the intake passage and the canister, the canister absorbing the evaporative fuel generated in the fuel tank, and the purge valve supplying the evaporative fuel absorbed by the canister to the intake passage for a purge control, comprising:

a fuel level detector to detect a quantity of fuel in the fuel tank;

a leak check system to examine leakage in the evaporative fuel control system by closing the atmosphere open/close valve while the engine is stopped and generating a negative pressure in the evaporative fuel control system; and a controller including a leak check control section to operate the leak check system, a refuel detecting section to determine by the fuel level detector whether the fuel tank has been refueled, a purge quantity totalizing section to add up the quantity of purge during operation of the engine, and a leak check stop section to prevent the leak check from occurring until the total purge quantity, as determined by the purge quantity totalizing section during operation of the engine after the refuel check section has determined that the fuel tank was refueled, is greater than a predetermined value.

2. An evaporative fuel control system for an internal combustion engine having a canister-disposed on an evaporative fuel control passage for absorbing evaporative fuel, said canister connecting to an intake passage for the engine and a fuel tank, an atmosphere open passage to permit the canister to open to the atmosphere, an atmosphere open/close valve disposed on the atmosphere open passage, and a purge valve disposed on the evaporative fuel control passage between the intake passage and the canister, the canister absorbing the evaporative fuel generated in the fuel tank, and the purge valve supplying the evaporative fuel absorbed by the canister to the intake passage for a purge control, comprising:

a fuel level detector to detect a quantity of fuel in the fuel tank;

a switching valve for connecting/disconnecting the atmosphere open passage to the atmosphere;

a reference pressure detector to detect a reference pressure in the evaporative fuel control system;

a pressure reducing means for generating a negative pressure inside of the evaporative fuel control system;

a leak check system to examine leakage in the evaporative fuel control system by using the detected reference pressure and a reduced pressure in which the switching valve is switched to an atmosphere shut side and the pressure reducing means generates a negative pressure in the evaporative fuel control system during stop of the engine; and a controller including a leak check control section to operate the leak check system, a refuel detecting section that works with said fuel level detector to determine whether the fuel tank has been refueled, a purge quantity totalizing section to add up the quantity of purge during operation of the engine, and a leak check stop section to prevent the leak check from occurring until the total purge quantity, as determined by the purge quantity totalizing section during operation of the engine after the refuel check section has determined that the fuel tank was refueled, is greater than a predetermined value.

3. The evaporative fuel control system according to claim 2, wherein said switching valve, reference pressure detector and pressure reducing means are included in said atmosphere open passage.

4. A method for controlling the loss of evaporative fuel from an internal combustion engine, including means for detecting a leak of evaporative fuel, comprising the steps of:

adsorbing the evaporative fuel generated in a fuel tank and containing the evaporative fuel in a canister disposed on an evaporative fuel control passage, said canister selectively opening to the atmosphere through an atmosphere open passage;

purging said adsorbed evaporative fuel from said canister by a purge system and supplying said purged evaporative fuel to said engine during operation of the engine;

detecting a quantity of fuel in said fuel tank;

testing for leakage of evaporative fuel by closing said canister to the atmosphere when said engine is stopped and generating a negative pressure in said evaporative fuel control passage;

detecting whether said fuel tank has been refueled;

determining a total quantity of evaporative fuel purged by said purge system during operation of the engine; and preventing said leak testing step from occurring until said total quantity of purged evaporative fuel is greater than a predetermined value if said fuel tank has been refueled.

* * * * *